US005560411A

United States Patent [19]

Becker

[11] Patent Number: 5,560,411

[45] Date of Patent: Oct. 1, 1996

[54] HEADER RAIL FOR AWNING

[75] Inventor: Kent Becker, Rome City, Ind.

[73] Assignee: The Dometic Corporation, LaGrange, Ind.

[21] Appl. No.: 281,464

[22] Filed: Jul. 27, 1994

[51] Int. Cl.[6] ..... E04F 10/06

[52] U.S. Cl. ..... 160/67; 160/47; 135/88.12

[58] Field of Search ..... 160/45, 47, DIG. 5, 160/67, 66; 135/88.12

[56] References Cited

U.S. PATENT DOCUMENTS

| | | | |
|---|---|---|---|
| 1,813,525 | 7/1931 | Astrup . | |
| 2,189,525 | 2/1940 | Treffeisen . | |
| 2,787,321 | 4/1957 | Dietz . | |
| 2,799,464 | 7/1957 | D'Azzo . | |
| 2,890,853 | 6/1959 | D'Azzo . | |
| 3,478,806 | 11/1969 | Darula . | |
| 3,789,903 | 2/1974 | Clark et al. . | |
| 3,918,511 | 11/1975 | Upton, Jr. | 160/67 |
| 3,980,121 | 9/1976 | McKee . | |
| 4,117,876 | 10/1978 | Bennett | 160/67 |
| 4,530,389 | 2/1985 | Quinn et al. . | |
| 4,634,172 | 1/1987 | Duda | 135/88.12 X |
| 4,658,877 | 4/1987 | Quinn . | |

FOREIGN PATENT DOCUMENTS

| | | | |
|---|---|---|---|
| 576829 | 1/1994 | European Pat. Off. | 160/45 |

*Primary Examiner*—Blair Johnson

*Attorney, Agent, or Firm*—Pearne, Gordon, McCoy & Granger

[57] ABSTRACT

A header rail is provided for mounting an awning having an awning rope and rafter arms to a building wall having siding with outwardly extending laps. The header rail includes an extrusion having a front wall and a pair of legs extending from the front wall. The legs have generally co-planar building wall engaging surfaces and space the front wall from the building wall to form a longitudinally extending interior space sized for accepting one or more of the siding laps. The front wall forms in cross-section a longitudinally extending awning rope retainer and a longitudinally extending guide way. Rafter extensions are provided to slide into the guide way and pivotally connect the rafter arms.

11 Claims, 2 Drawing Sheets

HEADER RAIL FOR AWNING

BACKGROUND OF THE INVENTION

1. Field of the Invention

The present invention generally relates to header rails for mounting awnings to vertical support surfaces, and more specifically to header rails for mounting awnings to buildings having siding.

2. Description of Related Art

An awning is often mounted to a vertical support surface, such as the side of a building, with a header rail. The header rail typically extends for the length of the awning and holds a head rod or awning rope and rafter arms of the awning so that the awning can be extended from the side of the building over a deck or patio to provide protection from the sun or rain. The header rail is firmly attached to the side of the building to provide the required rigidity for supporting the awning.

The awning can also be mounted to the side of the building by separately holding the awning rope with an awning rail and the rafter arms with individual brackets. This approach, however, may not provide the rigidity and straightness required for supporting the awning. Therefore, a header board, such as a length of 2×6 lumber, is first firmly attached to the side of the building. The individual brackets are then attached to the header board which provides the required rigidity for supporting the awning.

A building having siding, such as vinyl or aluminum siding, typically has an uneven surface created by the siding which does not allow the header rail or board to be attached firmly against the side of the building without damaging the siding. To firmly attach the header rail or board, the siding must be inwardly crushed or the siding in the contact area must be cut away. In either case, the siding is permanently damaged and at least a portion of the siding must be replaced if the header rail or header board is removed.

SUMMARY OF THE INVENTION

The present invention provides a header rail which solves the above-noted problems found in the prior art header rails and header boards. In accordance with the present invention, the header rail includes an extrusion having a front wall and a pair of legs extending from the front wall. The legs have generally co-planar building wall engaging surfaces to space the front wall from a building wall and form a horizontally extending interior space. Preferably the interior space is sized for accepting an outwardly extending lap of siding on the building wall. Therefore, the header rail can be mounted to the wall without crushing or cutting away the siding.

The front wall forms in cross-section a longitudinally extending awning rope retainer and a longitudinally extending guide way. The awning rope retainer is adapted for slidably receiving an awning rope attached at the inner edge of the awning. The guide way is adapted for receiving rafter extensions. Each rafter extension is adapted for pivotally connecting to an associated rafter arm of the awning.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

Figure 1:
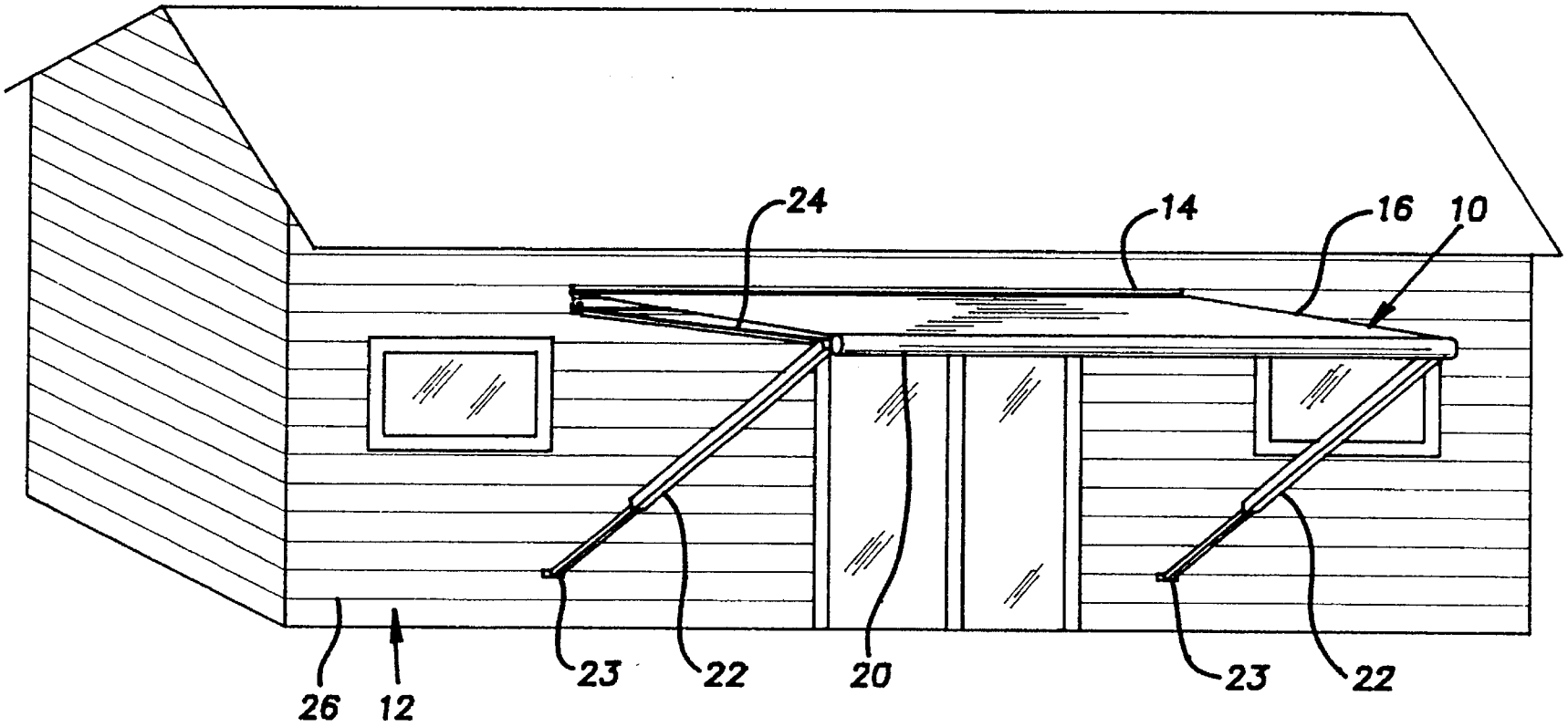
FIG. 1 is a perspective view of an awning mounted to a side of a building having siding by a header rail according to the present invention.

Referring now to the drawings, and in particular FIG. 1, therein is illustrated a retractable awning 10 mounted to a building wall 12 by a header rail 14 according to the present invention. The awning 10 is of a conventional type that is movable between an extended position (shown in FIG. 1) and a stored position adjacent the building wall 12. The awning 10 has a canopy or fabric 16 and an awning rope 18. The awning rope 18 is preferably polypropylene rope and is mounted in a hem or pocket provided at an inner edge of the canopy 16 (best seen in FIG. 3) and is secured to the header rail 14. The canopy 16 is rolled onto a roller tube 20 when the awning 10 is retracted to the stored position. A pair of support arms 22 each have an upper end rotatably supporting the roller tube 20 and a lower end pivotally connected to a bracket 23 mounted on the building wall 12. A pair of tension rafters or rafter arms 24 each have an upper end pivotally connected to the header rail 14 and a lower end slidably connected to an associated one of the support arms 22.

Figure 2:
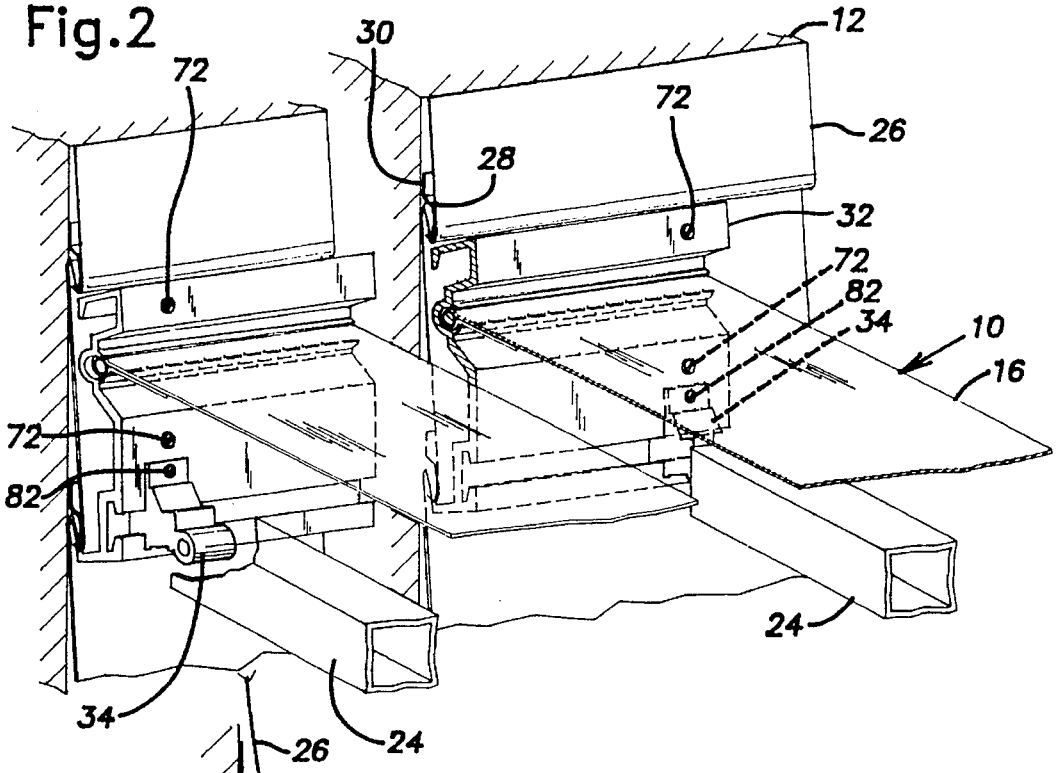
FIG. 2 is a fragmental perspective view of the awning of FIG. 1 in the area of the header rail.
Figure 3:
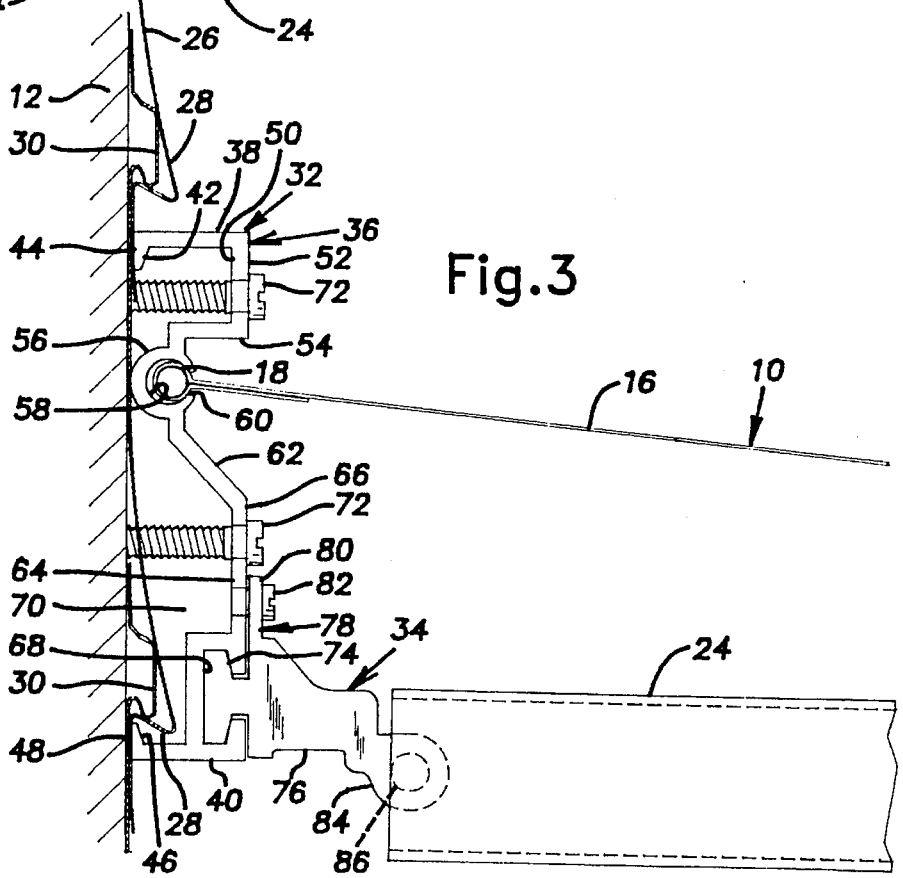
FIG. 3 is a side elevational view of the header rail of FIG. 2.

Referring now to FIGS. 2 and 3, the outer surface of the building wall 12 is covered with siding 26 such as aluminum or vinyl siding. The siding 26 is of a conventional type having horizontally extending panels with outwardly extending laps 28 at lower edges thereof. Each lap 28 extends over a retainer 30 formed at an upper edge of an adjacent panel. It should be noted however that the header rail 14 effectively mounts the awning 10 to other walls having uneven surfaces, such as corrugated panels, because the header rail provides the necessary rigidity and straightness.

The header rail 14 includes an extrusion 32 and rafter extensions 34. Both the extrusion 32 and rafter extensions 34 are preferably made of aluminum. The extrusion 32 has a length approximately equal to the width of the awning 10. As best seen in FIG. 3, the extrusion 32 has a front wall 36, a top leg 38, and a bottom leg 40. The top leg 38 is generally horizontal and inwardly extends from the top of the front wall 36 for the full length of the extrusion 32. A top flange 42 downwardly extends from the inner end of the top leg 38 and has a vertical wall engaging surface 44.

The bottom leg 40 is generally horizontal and inwardly extends from a bottom of the front wall 36 for the full length of the extrusion 32. A bottom flange 46 upwardly extends from the inner end of the bottom leg 40 and has a vertical wall engaging surface 48 that is co-planar with the wall engaging surface 44 of the top flange 42.

The front wall 36 has a generally vertical first portion 50 downwardly extending from the outer end of top leg 38. The first portion 50 has a first mounting surface 52 that is generally parallel to the wall engaging surface 44 of the top leg 42. A generally horizontal second portion 54 extends inwardly from the bottom end of the first portion 50 to an awning rope retainer 56. The awning rope retainer 56 includes a longitudinally extending opening 58 that is a partial circle, that is generally C-shaped, in cross-section. The awning rope retainer 56 also includes a longitudinally extending slot 60 at an outer side of the opening 58.

A third portion 62 extends downwardly and outwardly from the awning rope retainer 56 to a generally vertical fourth portion 64. The awning rope retainer 56 is inwardly positioned relative to the first portion 50 and fourth portion 64 in a recess formed by the second and third portions 54, 62. With the awning rope retainer 56 in this position, the second portion 54 forwardly extends above the slot 60 of the awning rope retainer 56. The fourth portion 64 has a mounting surface 66 that is preferably co-planar with the mounting surface 52 of the first portion 50 and is generally parallel to the wall engaging surface 48 of the bottom leg 40.

Formed below the mounting surface 66 of the fourth portion 64 is a longitudinally extending guide way 68. The guide way 68 is generally T-shaped in cross section and is generally parallel to the awning rope retainer 56. The guide way 68 is adapted for slidably receiving the rafter extensions 34.

The extrusion 32 is dimensioned such that the wall engaging surfaces 44, 48 of the top and bottom legs 38, 40 abut against the siding 26 covering the building wall 12 at positions where the siding 26 is generally adjacent to the building wall 12. Typically, this will be at the top portions of adjacent siding panels. The front wall 36 and legs 38, 40 form an interior space 70 that is sized so that the lap 28 between the adjacent panels extends into the interior space 70. It will be noted that for siding having a small width, the interior space is sized to receive more than one lap.

Openings for mounting fasteners 72 are preferably preformed in the first mounting surface 52 and the second mounting surface 66. Each opening in the first mounting surface 52 is directly above one of the openings in the second mounting surface 66. Preferably, the openings are spaced eight inches between centers in the longitudinal direction. The eight inch spacing allows the extrusion 32 to be mounted to walls having studs with 16 or 24 inch spacings.

The rafter extensions 34 have a slide portion 74 that is generally T-shaped and adapted for sliding within the guide way 68 of the extrusion 32 after being inserted into the end of the guide way 68. Adjacent the slide portion 74 is a body portion 76 having an upwardly extending flange 78. The body portion 76 and flange 78 abut the outer side of the front wall 36. The flange 78 upwardly extends a distance to overlap the fourth portion mounting surface 66 and has a mounting surface 80 generally parallel to the fourth portion mounting surface 66. An opening for a mounting fastener 82 is preferably preformed in the flange 78. A generally cylindrically-shaped hinge portion 84 is located downwardly and forwardly of the body portion 76. A longitudinally extending opening 86 is provided for accepting a pivot pin that pivotally attaches the associated tension rafter 24 as is conventional. The body portion 76 and the hinge portion 84 are each adapted to allow downward rotation of the tension rafter 24 when the awning 10 is retracted.

It should be noted that an additional tension rafter can be located between the tension rafters 24 along the sides of the awning 10 to further tension the awning canopy 16. The rafter extension for the additional rafter arm is preferably has a hook adapted for snapping into the guide way 68 anywhere along the length of the extrusion. Therefore, the additional rafter arm can be installed to the header rail 14 after the rafter extensions 34 for the side tension rafters 24 are firmly fastened in place and blocking the ends of the guide way 68 in the extrusion 32.

The awning 10 is mounted to the building wall 12 by first cutting the extrusion 32 to a length generally equal to the width of the awning 10. Preferably, the extrusion 32 is cut to a length that positions the mounting fastener openings generally adjacent each end of the cut extrusion 32. Therefore, it may be required to cut the extrusion 32 to a length slightly greater than the width of the awning 10. The extrusion 32 is positioned on the building wall 12 at a desired height, and if the building wall 12 has siding 26, the extrusion 32 is vertically positioned so that the adjacent lap 28 extends into the interior space 70 of the extrusion 32. The extrusion 32 is longitudinally positioned such that the mounting fastener openings are at studs in the building wall 12. The fasteners 72 are placed through the mounting fastener openings and into the building wall 12 to secure the extrusion 32 to the building wall 12.

The awning rope 18 at the inner edge of the awning canopy 16 is slid into the awning rope retainer 56 from one end so that the awning rope 18 is within the opening 58 and the awning canopy 16 forwardly extends out of the slot 60. At the same time, the rafter extensions 34 which have been previously pivotally attached to the tension rafters 24 are slid into the guide way 68. The second mounting surface 66 of the extension 32 is drilled to match each preformed flange opening of the rafter extension flange 78. The fasteners 82 are placed into the openings to secure the rafter extensions 34 to the extrusion 32 to prevent the rafter extensions 34 from sliding within the guide way 68. The awning 10 is then operated in a conventional manner.

Although a particular embodiment of the invention has been disclosed in detail, it is understood that the invention is not limited correspondingly in scope, but includes all changes and modifications coming within the spirit and terms of the claims appended hereto.

What is claimed is:

1. A header rail for mounting an awning to a support wall having siding panels with upper portions located adjacent the support wall and lower portions with outwardly extending laps, said header rail comprising a front wall having an awning attachment, a top leg extending from a top end of said front wall, a bottom leg extending from a bottom end of said front wall, a recess formed in said front wall between said top and bottom legs, a C-shaped opening formed in said front wall having a longitudinally extending slot within said recess, and generally co-planar support wall engaging surfaces provided only by said top and bottom legs and spaced apart effective for engaging only the upper portions of adjacent siding panels, wherein said top and bottom legs and said front wall form an interior space sized for accepting the outwardly extending lap located between the upper portions of the adjacent siding panels.

2. The header rail according to claim 1, wherein said front wall has at least two mounting surfaces generally parallel to said wall engaging surfaces for fasteners to attach said header rail to said support wall.

3. The header rail according to claim 2, wherein said mounting surfaces have a plurality of preformed openings for said fasteners.

4. The header rail according to claim 3, wherein the openings are longitudinally spaced with approximately eight inches between centers of said openings.

5. The header rail according to claim 3, wherein said slot at an outer side of said front wall and located between said mounting surfaces.

6. The header rail according to claim 5, wherein said slot is inwardly recessed from said outer side of said front wall.

7. The header rail according to claim 6, wherein said front wall forms a longitudinally extending guide way generally adjacent one of said mounting surfaces.

8. The header rail according to claim 7, wherein said guide way is generally T-shaped in cross section.

9. The header rail according to claim 7, further comprising an extension adapted for sliding in said guide way and having a flange adapted for engaging said mounting surface adjacent said guide way.

10. A header rail for installation of an awning having an awning rope and rafter arms with pivotally connected extensions to a building wall having siding panels with upper portions located adjacent the building wall and lower portions having outwardly extending laps, said header rail comprising a front wall forming a longitudinally extending awning rope retainer and a longitudinally extending guide way adapted to slidably receive the extensions of the rafter arms, a top leg extending from a top end of said front wall, a bottom leg extending from a bottom end of said front wall, a recess formed in said front wall between said top and bottom legs, a C-shaped opening formed in said front wall having a longitudinally extending slot within said recess, and generally co-planar building wall engaging surfaces provided only by said top and bottom legs and spaced apart a distance effective for engaging only the upper portions of adjacent siding panels, wherein said top and bottom legs and said front wall form a longitudinally extending interior space sized for accepting the outwardly extending lap located between the upper portions of the adjacent siding panels without engaging the outwardly extending lap.

11. A retractable awning mounted to a building wall having siding panels with upper portions located adjacent the building wall and lower portions having outwardly extending laps, said awning comprising:

a header rail secured to the building wall and having a front wall, a top leg extending from a top end of said front wall, a bottom leg extending from a bottom end of said front wall, a recess formed in said front wall between said top and bottom legs, a C-shaped opening formed in said front wall having a longitudinally extending slot within said recess, and generally co-planar building wall engaging surfaces provided only by said top and bottom legs and spaced apart a distance effective for engaging only the upper portions of adjacent siding panels, wherein said top and bottom legs and said front wall form a longitudinally extending interior space sized for accepting the outwardly extending lap located between the upper portions of the adjacent siding panels without engaging the outwardly extending lap;

a canopy having an awning rope secured within said C-shaped opening in said front wall of said header rail;

a roller about which the canopy can be rolled;

a pair of support arms having one end operatively connected to an associated end of the roller and another end contacting a supporting surface; and a pair of tension rafters each having one end operably secured to said front wall of said header rail and another end operably connected to an associated one of said support arms.

* * * * *

UNITED STATES PATENT AND TRADEMARK OFFICE

CERTIFICATE OF CORRECTION

PATENT NO. : 5,560,411

DATED : October 1, 1996

INVENTOR(S) : Kent Becker

It is certified that error appears in the above-indentified patent and that said Letters Patent is hereby corrected as shown below:

Column 4, line 58 (Claim 5, line 1), delete "3" and insert --2--.

Column 4, line 58 (Claim 5, line 1), after "slot" insert --is--.

Signed and Sealed this

Fourteenth Day of January, 1997

Bruce Lehman

*Attest:*

BRUCE LEHMAN

*Attesting Officer*

*Commissioner of Patents and Trademarks*